United States Patent [19]

Kupfert

[11] Patent Number: 4,846,305

[45] Date of Patent: Jul. 11, 1989

[54] APPARATUS FOR ROTATABLY POSITIONING A LADDER WITHIN A STAIRWAY

[76] Inventor: Bernard J. Kupfert, 2511 W. Wardcliffe Dr., Apt. G, Peoria, Ill. 61604

[21] Appl. No.: 276,950

[22] Filed: Nov. 28, 1988

[51] Int. Cl.[4] ..... E06C 7/42

[52] U.S. Cl. ..... 182/97; 182/109; 182/111; 182/200

[58] Field of Search ..... 182/107, 108, 109, 111, 182/65, 97, 200, 129, 91

[56] References Cited

U.S. PATENT DOCUMENTS

| | | | |
|---|---|---|---|
| 270,008 | 1/1883 | Bridges . | |
| 1,013,751 | 1/1912 | Dougherty | 182/65 |
| 2,868,427 | 1/1959 | Hess . | |
| 3,891,053 | 6/1975 | Burton | 182/97 |
| 3,920,097 | 11/1975 | Brebrier . | |
| 4,457,397 | 7/1984 | Scala . | |
| 4,671,383 | 6/1987 | Huang . | |
| 4,679,652 | 7/1987 | Cervantes | 182/200 |

FOREIGN PATENT DOCUMENTS

| | | | |
|---|---|---|---|
| 3529040 | 2/1987 | Fed. Rep. of Germany | 182/200 |
| 1154440 | 11/1966 | United Kingdom . | |
| 2142076 | 1/1985 | United Kingdom | 182/111 |
| 2155983A | 10/1985 | United Kingdom . | |

*Primary Examiner*—Reinaldo P. Machado

*Attorney, Agent, or Firm*—Sixbey, Friedman, Leedom & Ferguson

[57] ABSTRACT

An apparatus 10 provides easy, stable positioning of a ladder within a stairwell. The apparatus 10 includes multiple base portions 14, 24 which traverse and rest upon multiple steps 20, 28. Sidewall braces 38, 40 adjustably engage the stairwell sidewalls to inhibit lateral movement of the base portions 14, 24. A bracket 52 is pivotally connected to the base of the ladder and rotatably connected to the base portions 24. Accordingly, the ladder is free to be manually rotated and pivoted to rest against any of the walls forming the stairwell.

9 Claims, 1 Drawing Sheet

Fig.1
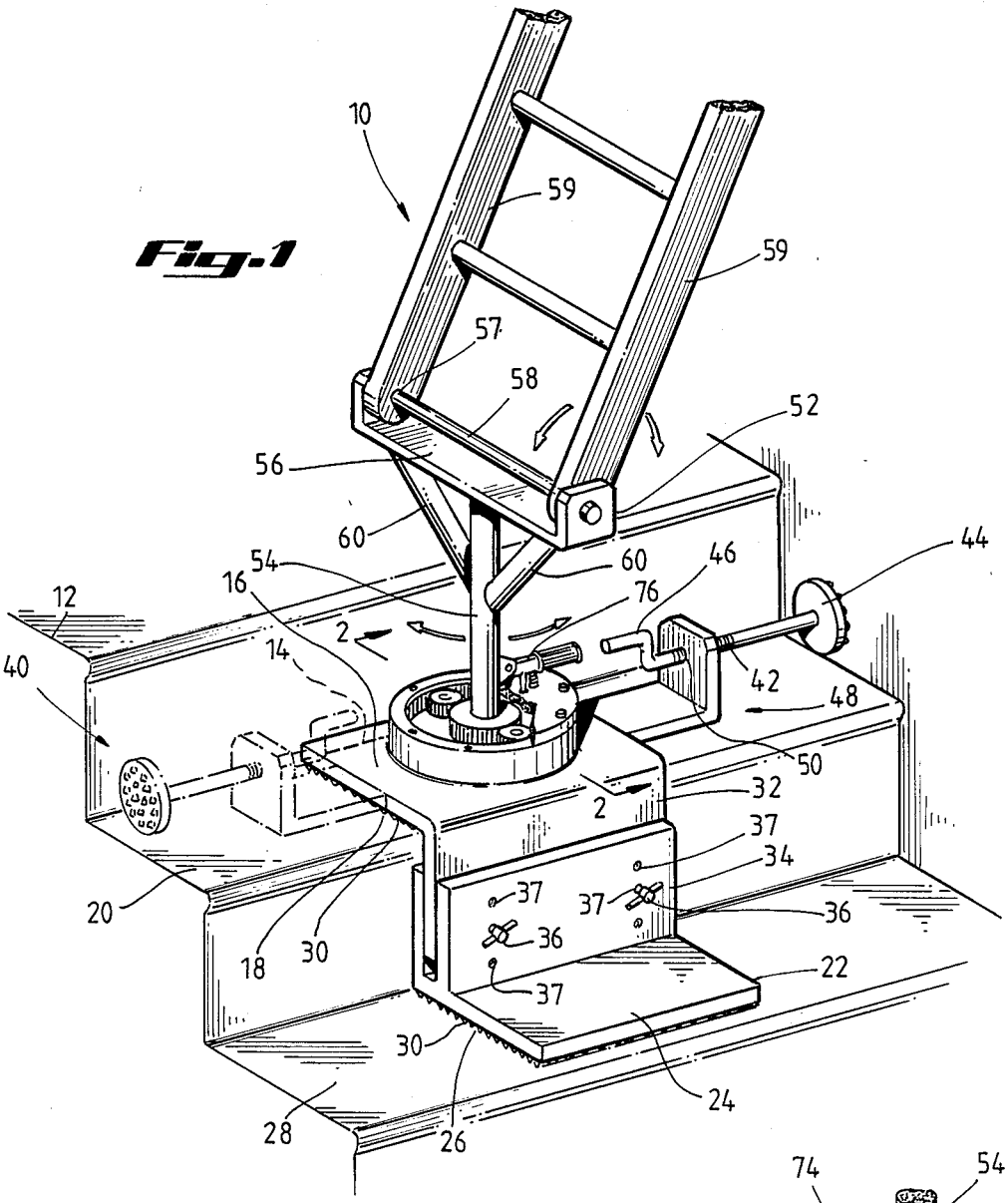
Fig.2
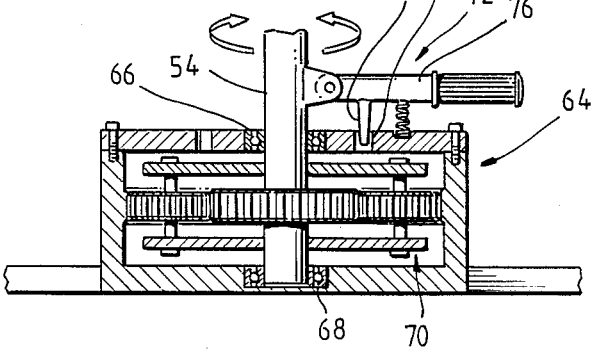
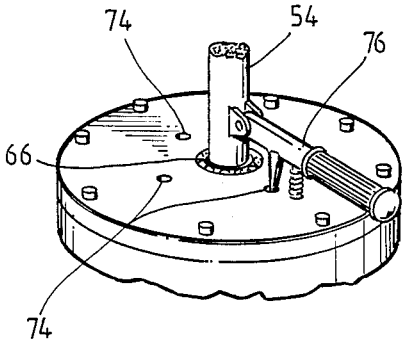
Fig.3

APPARATUS FOR ROTATABLY POSITIONING A LADDER WITHIN A STAIRWAY

BACKGROUND OF THE INVENTION

1. Field of the Invention

This invention relates generally to an apparatus for supporting the base of a ladder, and more particularly, to an apparatus for supporting the base of a ladder on a stairway such that the ladder may be rotated to any position where an upper portion of the ladder contacts the walls of the stairwell.

2. Description of the Related Art

In the past, various devices have been suggested in order to safely and conveniently use a ladder within a stairwell. These previous devices typically connect to the base of a ladder and provide adjustable length legs to correct for the uneven surface on which the ladder is to be placed. For example, U.S. Pat. No. 4,671,383 issued June 9, 1987 to Huang, illustrates a ladder leveller wherein the "downhill" leg of the ladder is adjustable to a length which compensates for the pitch of the stairway. The structure of Huang, however, prevents its use on opposite sidewalls without adjusting the leg lengths. Typically, a ladder is constructed with rungs having a flat step portion placed at an angle relative to the siderails of the ladder. Thus, a ladder is intended to be used from a single side and cannot simply be pivoted from one sidewall to the other. Rather, the relative leg lengths must be reversed when an operator desires to move from one sidewall to the other. Obviously, the leg lengths must be equalized when the operator desires to move to the stairwell endwall.

Alternatively, U.S. Pat. No. 4,457,397, issued July 3, 1984 to Schala, discloses a basic platform with adjustable legs that traverse multiple steps to provide a substantially planar base area on which to place the ladder. The platform disclosed in Schala is large and cumbersome, requiring six separate adjustments to properly position the platform within the stairwell. Aside from being difficult to position and adjust, Schala further suffers from the disadvantage of the ladder being unattached to the platform. Accordingly, a ladder placed on the Schala platform risks the possibility that the ladder base would slide rearwardly, causing an operator to fall. Schala has suggested the use of stepped portions on the platform surface which engage the base of the ladder and prevent undesirable movement of the base. However, these steps are necessarily positioned within the area in which an operator is expected to walk and, therefore, a risk exists that an operator will trip and fall. Further, reorienting the ladder to rest against the other sidewall or endwall requires the operator to support and balance the entire ladder. These ladders are typically large, heavy devices which prove difficult to maneuver, particularly within the close confines of a stairwell.

The present invention is directed to overcoming one or more of the problems as set forth above.

SUMMARY OF THE INVENTION

The primary object of the present invention is to provide a ladder support which is easily adjustable to conform to the configuration of a particular staircase.

Another object of the present invention is to provide a ladder support which is secured against undesirable lateral movement on the stairs.

Yet another object of the present invention is to provide a ladder support which freely rotates whereby the ladder is positionable on any one of the stairwell walls.

Still another objective of the present invention is to provide a ladder support which prevents undesirable movement of the base of the ladder relative to the ladder support.

To attain these and other objectives an apparatus is provided for supportively positioning the ladder on a stairway. The apparatus is comprised of a first base which has an upper and lower surface where the lower surface is adapted to frictionally engage a first tread of the stairway. The second base includes an upper and lower surface where the lower surface is similarly adapted to frictionally engage a second tread of the stairway. Means fixedly interconnects the first and second bases at one of a plurality of preselected distances apart. A bracket pivotally connects a base portion of a ladder whereby the ladder is free to pivot in a plane parallel to the ladder longitudinal axis. A rotary coupling interconnects the upper surface of one of the first and second bases and the bracket, whereby the bracket and ladder are free to rotate in a plane substantially parallel to the first and second treads.

BRIEF DESCRIPTION OF THE DRAWINGS

Other objects and advantages of the invention will become apparent upon reading the following detailed description and upon reference to the drawings in which:

FIG. 1 is a perspective view of the ladder and ladder support positioned on a stairway;

FIG. 2 a cross-sectional view of the base portion and rotary coupling of the ladder support; and FIG. 3 is a top view of the base of the ladder support.

While the invention is susceptible to various modifications and alternative forms, specific embodiments thereof have been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DESCRIPTION OF THE PREFERRED EMBODIMENTS

Turning now to the drawings and referring first to FIG. 1, a perspective view of the apparatus 10 positioned on a stairwell 12 is shown. The apparatus 10 includes a first base 14 which has an upper and lower surface 16, 18 where the lower surface 16 is adapted to frictionally engage a first tread 20 of the stairway 12. A second base 22 also has an upper and lower surface 24, 26 with the lower surface 24 being similarly adapted to frictionally engage a second tread 28 of the stairway 12.

The lower surfaces 18, 26 of each of the bases 14, 24 includes a non-skid material 30. This non-skid material 30 aids the base in maintaining its position on the stairway 12 by increasing the coefficient of friction to inhibit undesirable slipping of the bases 14, 24 across the surface of the treads 20, 28.

The two bases 14, 24 are connected as an integral unit by means for fixedly interconnecting the first and second bases 14, 24 at one of a plurality of preselected distances apart. The means includes the first base portion 14 having a vertical section integrally formed therewith and extending downwardly toward the second base 24. The second base 24 is correspondingly constructed to include a vertical portion 34 which extends upwardly from the second base 24 towards the first base 14. These two vertical portions 32, 34 are connected together by a pair of nut and bolt arrangements 36. The nut and bolt arrangements 36 pass through one of a set of plurality of bores 37 horizontally passing through both of the vertical plates 32, 34.

Proper selection of corresponding bores 37 in the plates 32, 34 allow the bases 14, 24 to be positioned at a plurality of distinct distances apart so as to readily accommodate a wide variety of stairways. The vertical distance between treads 20 and 28 can reasonably be expected to be one of a plurality of standard sizes. Accordingly, as illustrated in FIG. 1, three pairs of bores 37 in each of the plates 32, 34 provide for nine separate and distinct vertical positions.

It should be appreciated that the plates 32, 34 are self adjusting. Since the bases 14, 24 are supported in their desired positions by the treads 20, 28, the proper bores 37 will automatically be aligned.

While the non-skid material 30 generally aids the apparatus 10 by reducing slipping of the bases 14, 24 in all directions, a means further reduces movement of the base by fixing the first and second bases 14, 24 against lateral movement. The means includes a pair of sidewall braces 38, 40. The braces 38, 40 are connected to one of the first and second bases 14, 24 and frictionally engage the sidewalls which form the stairwell.

Each of the sidewall braces 38, 40 includes a threaded rod 42 having first and second end portions. A frictional pad 44 is connected to the first end portion of the rod 42 and a handle 46 is connected to the rod 42 second end portion. The frictional pad 44 preferably includes a non-skid material on its sidewall engaging surface to increase the coefficient of friction and reduce undesirable movement along the sidewall.

A bracket 48 is connected to the first base 14 and includes a vertical portion with a horizontal bore extending therethrough in a direction generally perpendicular to the sidewalls. The bore 50 is threaded in a manner to accept the threaded portion of the rod 42. Therefore, clockwise rotation of the handle 46 causes the frictional pad 44 to move outwardly and engage the sidewall. Conversely, counterclockwise rotation of the handle 46 displaces the frictional pad 44 in a direction toward the base 14 and away from the sidewall. Thus, it can be seen that the combination of the two sidewall braces 38, 40 interact to position the apparatus 10 at the desired location between the sidewall and fixes the apparatus 10 position to prevent undesirable movement thereof.

A bracket 52 is pivotally connected to a base portion of the ladder whereby the ladder is free to pivot in a plane parallel to the ladder longitudinal axis and perpendicular to the ladder rungs. A vertical pipe 54 is connected to a midpoint of a substantially flat ladder support 56. Each end of the ladder support 56 is bent upwardly and has a substantially aligned bore extending therethrough. A bolt 58 passes through the aligned bores within the end portions of the ladder support 56. Within the base portion of the ladder a pair of substantially aligned bores 57 extend through the vertical rails 59 such that the bolt 58 also passes through these rail bores 57, capturing the ladder and preventing undesirable removal from the ladder support 56 yet still allowing pivotal movement of the ladder within the ladder support 56. The ladder support 56 receives additional structural rigidity from a pair of support rods 60 extending from each end portion of the support bracket 56 to the vertical pipe 54. It should be noted that the support rod 60, vertical pipe 54 and ladder support 56 are preferably constructed of a metallic substance and are joined together by a welding process.

A rotary coupling 62 interconnects the upper surface 16 of the first base 14 and the bracket 52. Accordingly, the bracket 52 and ladder are free to rotate in a plane substantially parallel to the upper surface of the first and second stair treads 20, 28. This allows the ladder to be positioned with the upper portion of the ladder engaging one of the sidewalls and the end wall of the stairwell. Construction of the rotary coupling 62 can best be seen and described in conjunction with FIG. 2 wherein a cross-sectional view of the rotary coupling is illustrated. The vertical pipe 54 of the bracket 52 extends into a housing 64. The housing 64 includes a pair of bearings 66, 68 positioned at the top and bottom of the housing 64 and disposed about the vertical pipe 54. The race portion of the bearings 66, 68 is press fit into the housing 64 and the ball bearings are free to rotate with the vertical pipe 54. A gear train 70 is disposed within the housing 64 about the vertical pipe 54 and provides for smooth easy rotation of the bracket 54 and ladder. It should be appreciated that the rotary coupling 62 is also positionable on the upper surface 24 of the second base 22. In either location it is important that the ladder support 56 and support rods 60 be positioned at a height sufficient to clear the immediately higher stair.

A positioning means 72 fixes the rotary coupling 62 against rotation at a plurality of preselected rotary positions. The positioning means 72 includes a plurality of bores disposed about the rotary coupling extending into the upper surface 16 of the first base 14. A lock handle 76 is connected to the bracket 52 and is free to rotate therewith. The handle 76 has an engagement pin 78 and is positionable at a first preselected position with the engagement pin 78 disposed within one of the plurality of positioning bores 74 whereby the bracket 52 is fixed against rotation. In a second position the handle 76 is positioned such that the engagement pin 78 is spaced from the upper surface of the base 14 whereby the bracket 52 is free to rotate.

In FIG. 3, it can be seen that the positioning bores 74 are disposed at 90° rotary positions such that when the engagement pin is located within the positioning bores 74 the bracket 52 and ladder are positioned to respectively contact the sidewalls and endwall. Accordingly, it can be seen that by moving the handle 76 to the second position the ladder and bracket 52 are free to rotate and be appropriately positioned. Once the ladder is positioned to one of the three desired locations, the handle 76 is moved to the first position wherein the engagement pin engages one of the positioning bores 74 and prevents undesirable rotation of the ladder.

Other aspects, objects and advantages of this invention can be obtained from a study of the drawings, the disclosure, and the appended claims.

I claim:

1. An apparatus for supportably positioning a ladder on a stairway, said ladder having a pair of side rails extending parallel to the ladder longitudinal axis and a plurality of rungs extending perpendicular to said longitudinal axis between said side rails , comprising:

a first base having an upper and lower surface, the lower surface being adapted to frictionally engage a first tread of the stairway;

a second base having an upper and lower surface, the lower surface being adapted to frictionally engage a second tread of the stairway;

means for fixedly interconnecting the first and second bases at one of a plurality of preselected distances apart;

a bracket pivotally connected to a base portion of the ladder whereby the ladder is free to pivot in a plane parallel to the ladder longitudinal axis and perpendicular to the ladder rungs; and a rotary coupling interconnecting the upper surface of one of the first and second bases and the bracket whereby the bracket and ladder are free to rotate in a plane substantially parallel to the first and second treads.

2. An apparatus, as set forth in claim 1, wherein said means includes said first and second bases each having a substantially vertical section extending therefrom in a direction generally toward and away from the second tread respectively, each of said vertical sections having a plurality of corresponding bores extending therethrough and being adapted for receiving a bolt and nut combination.

3. An apparatus, as set forth in claim 1, including positioning means for fixing said rotary coupling against rotation at a plurality of preselected rotary positions.

4. An apparatus, as set forth in claim 3, wherein said positioning means includes a plurality of bores disposed about the rotary coupling and extending into the upper surface of one of the first and second bases, and a lock handle connected to the bracket and free to rotate therewith, said handle having an engagement pin and being positionable at a first preselected position with said engagement pin disposed within one of said plurality of positioning bores whereby the bracket is fixed against rotation and a second position with said engagement pins spaced from the upper surface of said base whereby said bracket is free to rotate.

5. An apparatus for supportably positioning a ladder within a stairwell, said stairwell including a plurality of stairs having first and second end portions and an upper surface, first and second sidewalls disposed adjacent the stair first and second end portions, and an end wall interconnecting the first and second sidewalls; said apparatus comprising:

a first base having an upper and lower surface, the lower surface being adapted to frictionally engage the upper surface of a first stair;

a second base having an upper and lower surface, the lower surface being adapted to frictionally engage the upper surface of a second stair, said first and second bases being fixedly interconnected;

means for fixing the first and second bases against lateral movement in a direction toward the stair first and second end portions;

a bracket pivotally connected to a base portion of the ladder whereby the ladder is free to pivot in a plane parallel to the ladder longitudinal axis;

a rotary coupling interconnecting the upper surface of one of the first and second bases and the bracket whereby the bracket and ladder are free to rotate in a plane substantially parallel to the upper surface of the first and second stairs such that the ladder is free to be positioned with an upper portion of the ladder engaging one of the first and second sidewalls and the end wall.

6. An apparatus, as set forth in claim 5, wherein said means includes a pair of sidewall braces adjustably connected to one of the first and second bases and frictionally engaging said sidewalls.

7. An apparatus, as set forth in claim 6, wherein said sidewall braces each include a threaded rod having first and second end portions, a frictional pad connected to the rod first end portion, a handle connected to the rod second end portion, and a side bracket connected to one of the first and second bases and having a vertical portion with a horizontal bore extending therethrough in a direction generally toward said sidewalls, said bore being correlatively threaded and threadably engaging said threaded rod whereby rotation of said handle produces a corresponding movement of said frictional pad in a direction generally perpendicular to said sidewalls.

8. An apparatus, as set forth in claim 5, including positioning means for fixing said rotary coupling against rotation at a plurality of preselected rotary positions.

9. An apparatus, as set forth in claim 8, wherein said positioning means includes a plurality of bores disposed about the rotary coupling and extending into the upper surface of one of the first and second bases, and a lock handle connected to the bracket and free to rotate therewith, said handle having an engagement pin and being positionable at a first preselected position with said engagement pin disposed within one of said plurality of positioning bores whereby the bracket is fixed against rotation and a second position with said engagement pin spaced from the upper surface of said base whereby said bracket is free to rotate.

* * * * *